United States Patent [19]

Said et al.

[11] Patent Number: 4,466,453

[45] Date of Patent: Aug. 21, 1984

[54] COIN COUNTING AND SORTING APPARATUS

[75] Inventors: Adil S. Said, Dallas; Antonio Schober, Richardson, both of Tex.

[73] Assignee: Global Banking Systems, Inc., Garland, Tex.

[21] Appl. No.: 388,962

[22] Filed: Jun. 16, 1982

[51] Int. Cl.[3] ..... G07D 3/10

[52] U.S. Cl. ..... 133/3 C; 133/3 H

[58] Field of Search ..... 133/3 R, 3 A, 3 B, 3 C, 133/3 D, 3 E, 3 F, 3 G, 3 H

[56] References Cited

U.S. PATENT DOCUMENTS

| | | | |
|---|---|---|---|
| 2,289,002 | 7/1942 | Fleming et al. | 133/3 R X |
| 4,210,801 | 7/1980 | Gomez et al. | 406/133 X |
| 4,275,751 | 6/1981 | Bergman | 133/3 C |
| 4,360,034 | 11/1982 | Davila et al. | 133/3 D |

*Primary Examiner*—F. J. Bartuska
*Attorney, Agent, or Firm*—Douglas A. Lashmit

[57] ABSTRACT

A coin sorter and counter includes a plurality of spaced apart sorting plates rotatably disposed within an annular drum inclined at a fixed angle with respect to the horizontal, each sorting plate including a plurality of openings therethrough configured to ratain coins of a particular size while passing all coins of a smaller size. An automatic coin feed mechanism for supplying coins to the sorting plates is energized and deenergized responsive to the level of coins on any of the plurality of plates, and an adaptive coin ejection mechanism removes sorted coins from the respective sorting plates one-by-one whereupon they are deposited into appropriate recepticles. The sorting plates and annular drum are cooperatively configured to accurately sort bent or otherwise damaged coins one-by-one without jamming. A sensor is provided adjacent the coin ejection mechanism to generate a signal each time a coin passes therethrough, the signals being detected and a count accumulated by a central processing unit.

3 Claims, 7 Drawing Figures

COIN COUNTING AND SORTING APPARATUS

BACKGROUND OF THE INVENTION

The present invention relates generally to coin handling machines and more specifically to an improved coin sorting and counting apparatus.

Numerous types of machines for sorting and counting a mixture of coins by their respective denominations are known in the are. One sorting method includes passing a random mixture of coins through a series of sorting plates, where each sorting plate has a plurality of openings therethrough which are slightly smaller than the diameter of the coin or token to be sorted by the respective plate. The sorting plates are arranged so that the largest coins are retained on the first plate, the next largest coins are retained on the second plate, and so forth. Means are also provided in prior machines for removing the sorted coins from the plates, counting the coins, and depositing them in appropriate receptacles. Examples of such machines are described in U.S. Pat. No. 2,289,002 to Fleming et al., entitled "Machine For Counting And Sorting Coins," and U.S. Pat. No. 4,210,801 to Gomez et al., entitled "Fare Collection System And Components Thereof."

It is desirable in such machines to have as high a sorting rate as possible with a minimum of counting and sorting errors. One problem frequently encountered is jamming caused by debris that is inadvertently deposited into the sorting mechanism. Another problem is the missorting, miscounting or jamming caused by bent or otherwise damaged coins and tokens. Further, some machines are difficult to service when a jam occurs.

SUMMARY OF THE INVENTION

The present invention provides an improved coin sorting and counting apparatus which rapidly and accurately counts and sorts a random mixture of coins without jamming.

In one embodiment of the present invention a plurality of sorting plates are axially affixed to a rotatable shaft and disposed within a fixed annular drum, the entire assembly being inclined at a fixed angle with respect to the horizontal. Each sorting plate includes a plurality of openings therethrough of a size slightly smaller than the size of the coin or token to be retained by that plate, yet large enough to pass all coins of a smaller size. The openings at the periphery of each sorting plate are configured to retain coins of a selected size and to cooperate with a coin ejection mechanism to remove the selected coins from the sorting one-by-one and discharge them into a track assembly. First sensor means are included in each track assembly to generate an electrical signal in response to the passage of each coin therethrough to provide an accurate count of the coins as they are sorted. A plurality of second sensor means are positioned in the annular drum and coupled to an automatic coin feed mechanism to disable the feed mechanism when the coins on any of the sorting plates reach a predetermined level, and to enable the feed mechanism when the coins again drop below the level of the sensor.

It is therefore an object of the present invention to provide an improved high speed coin sorting apparatus for accurately sorting a random mixture of coins or tokens without jamming.

Another object of the present invention is to provide improved coin sorting apparatus including means for accurately counting the sorted coins by their respective denominations.

Yet another object of the present invention is to provide a coin sorter-counter having an improved sorting mechanism including a plurality of axially mounted sorting plates, each having a plurality of openings therethrough configured to cooperate with a coin ejection mechanism to remove the sorted coins one-by-one without jamming.

Still another object is to provide apparatus as set forth above to accurately count and sort bent or otherwise damaged coins and tokens.

A further object is to provide a coin sorter-counter having an automatic coin feed mechanism operably responsive to the level of coins on any of the plurality of sorting plates.

Another object of the present invention is to provide a coin sorter-counter including a sorting mechanism, drive means therefor, and a coin ejection mechanism which are readily disengagable to provide access thereto.

Yet another object is to provide a coin sorting mechanism including an annular drum configured to minimize jamming while sorting bent or otherwise damage coins and tokens.

BRIEF DESCRIPTION OF THE DRAWINGS

Other objects and many of the attendant advantages of this invention will be readily appreciated as the same becomes better understood by reference to the following detailed description when considered in conjunction with the accompanying drawings, in which like reference numerals designate like parts, and wherein.

DESCRIPTION OF THE PREFERRED EMBODIMENT

Figure 1:
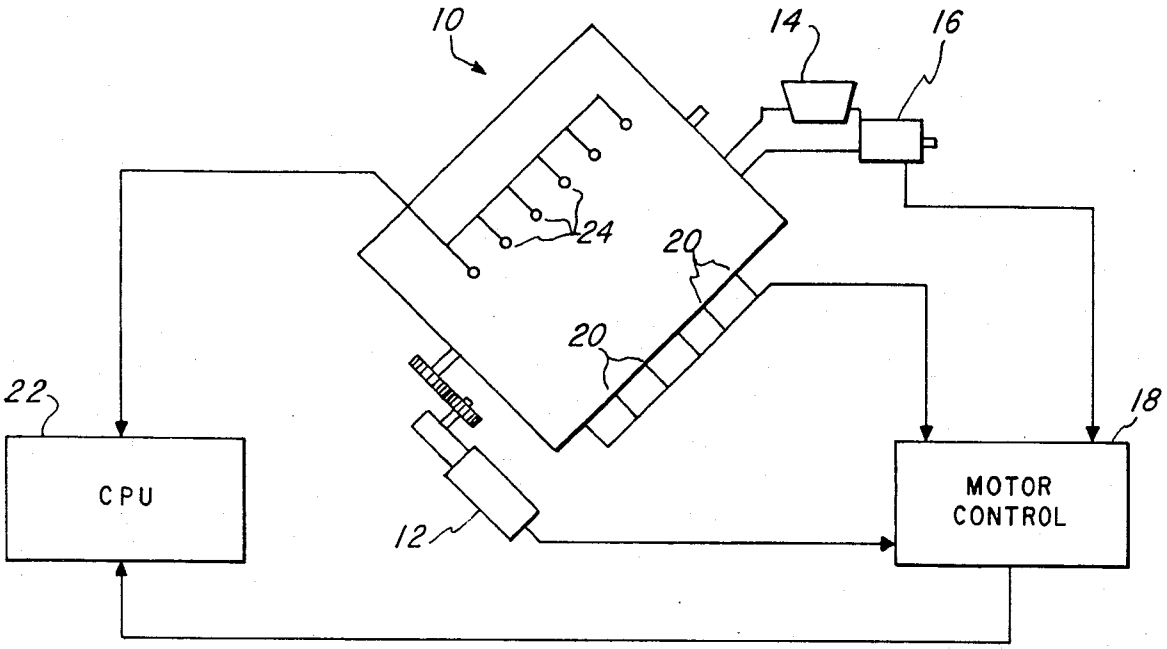
FIG. 1 is a diagrammatic view of one embodiment of a coin sorting and counting apparatus according to the present invention.

Referring now to the drawings, there is shown in FIG. 1 a diagrammatic view of a coin sorting and counting system including an improved sorting mechanism 10 driven by reversible drive means, for example, an electric motor 12. The system further includes at the upper portion of sorter 10 an automatic coin feed mechanism 14 having drive means such as motor 16. Sorter 10 is inclined at a fixed angle with respect to the horizontal to provide gravity feed of the coins therethrough as they are supplied from coin feeder 14. The details of the operation and structure of the sorter mechanism 10 are described hereinbelow. A motor control circuit 18 coupled to sorter drive motor 12 and coin feeder drive motor 16 determines the speed and direction of rotation of motor 12. Circuit 18 is further coupled to a plurality of coin level sensors 20 and, upon detection of a predetermined level of coins in sorter 10, deenergizes feed mechanism until such time that the level of coins drops below said predetermined level. A central processing unit CPU 22 is coupled to a plurality of counting sensors 24 disposed at the discharge area of sorter 10 to provide an accurate count of the sorted coins by denomination.

Figure 2:
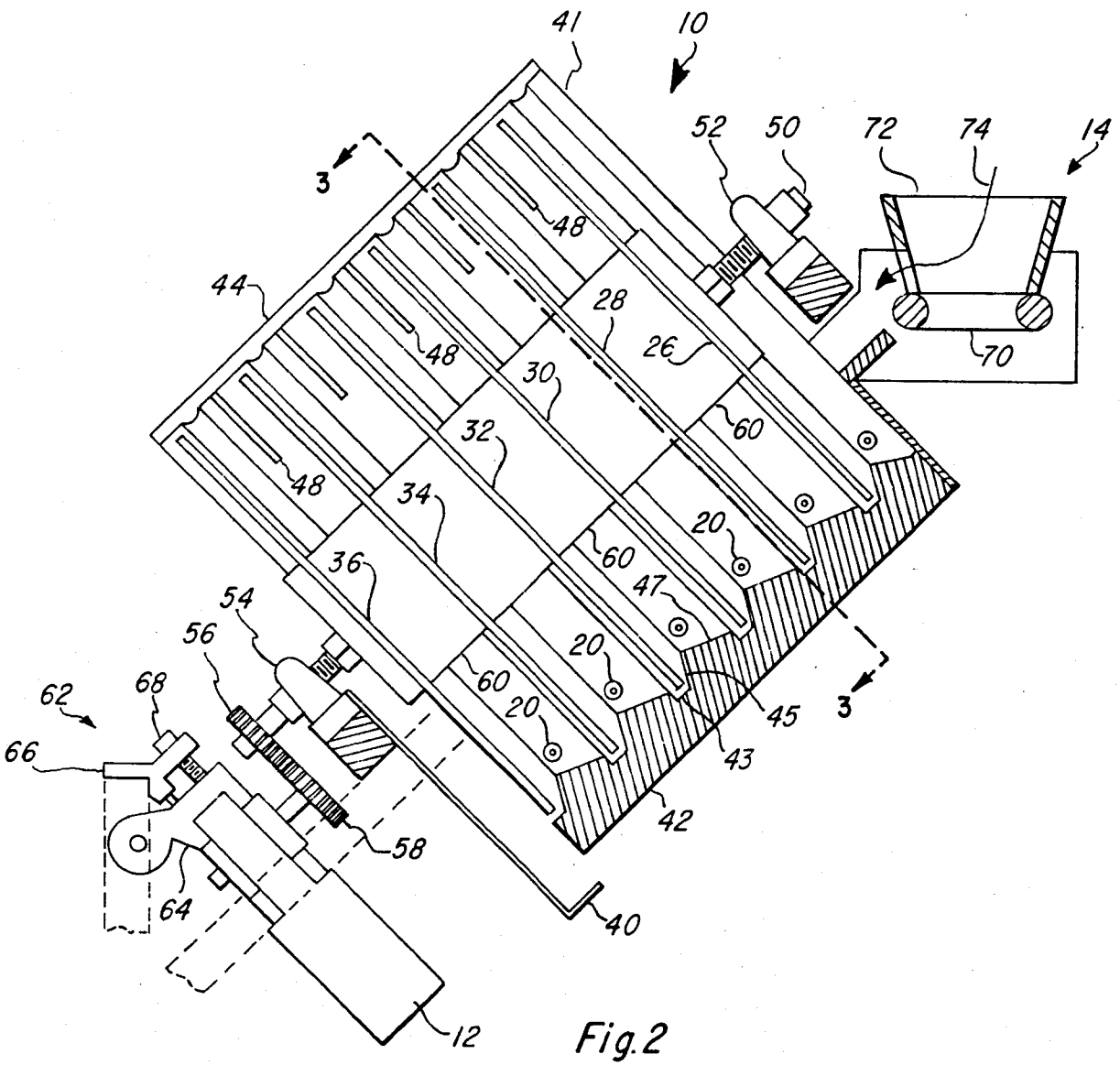
FIG. 2 is a side elevational view in partial vertical section illustrating the sorter mechanism and coin feed mechanism of the present invention in greater detail.
Figure 3:
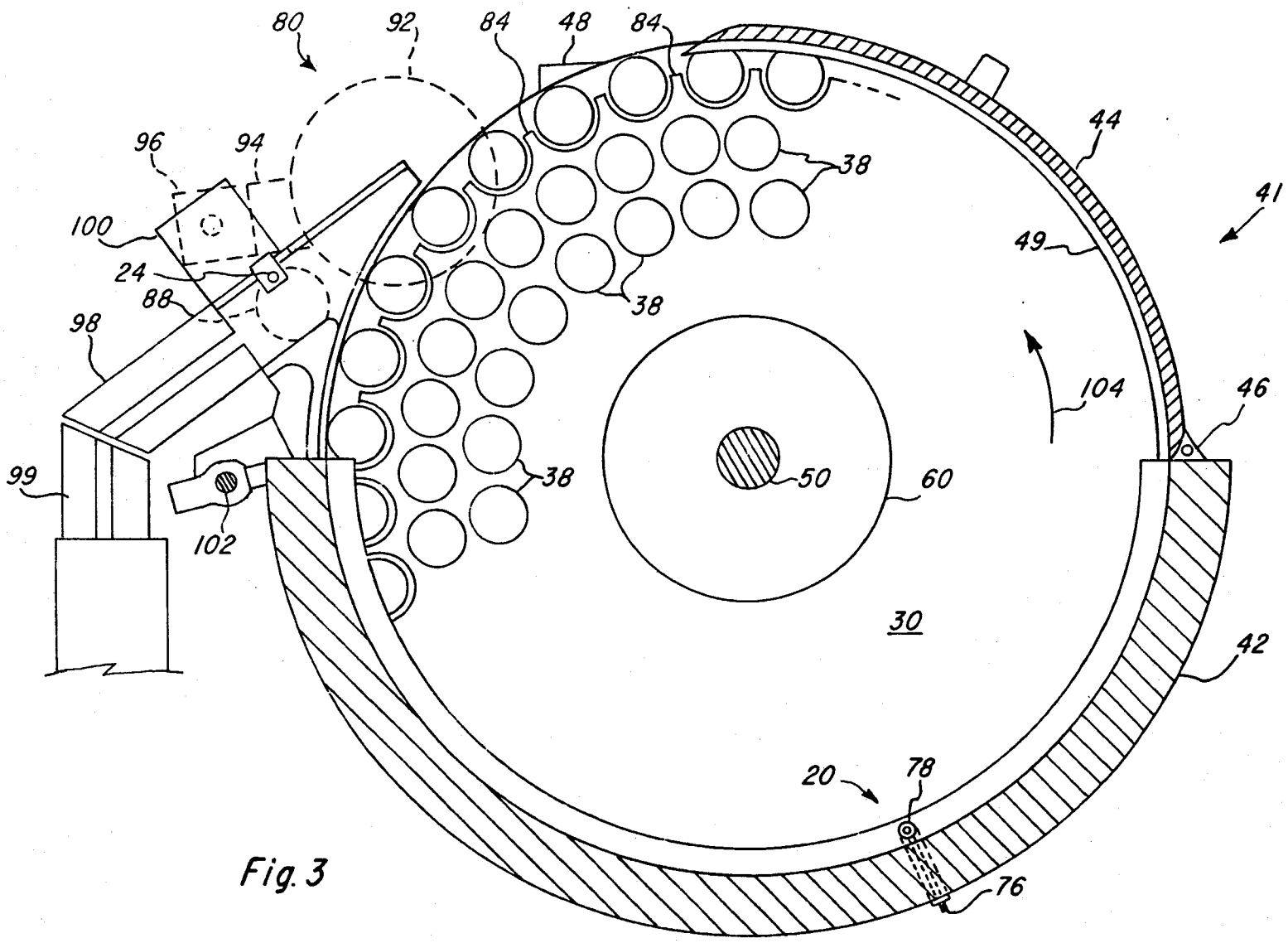
FIG. 3 is a view in section along the line 3—3 of FIG. 2 showing the details of one of the sorting plates and coin ejectors according to the present invention.
Figure 4:
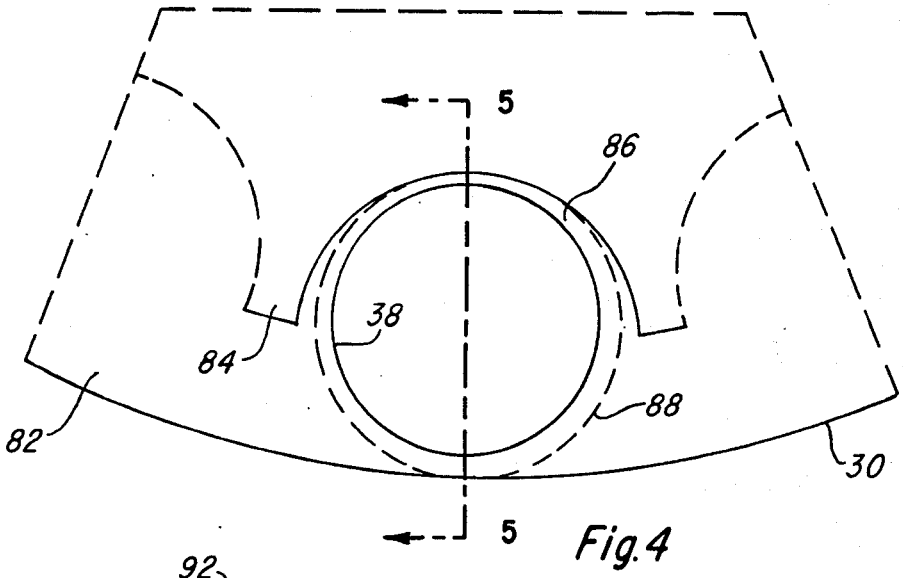
FIG. 4 is an enlarged plan view of a portion of the periphery of the sorting plate of FIG. 3 showing one of the coin retaining openings therein.

Coin sorting mechanism 10 will now be described in greater detail by reference to FIGS. 2–7. Sorter 10 comprises a plurality of sorting plates 26–36 for sorting, in one embodiment, coins of denominations of 50 cents, 25 cents, 5 cents, 1 cent, 10 cents, and one size of token, respectively. As shown in FIG. 3, each sorting plate 30 is essentially a flat disc containing a plurality of openings 38 therethrough, the openings in plate 26 being the largest and the openings in plate 36 being the smallest, with the openings in plate 26 being largest enough to pass all coins except 50 cent pieces, and the openings in plate 36 being smaller than the smallest coin or token to be sorted and counted. Small metallic debris and other foreign matter which may enter sorter 10 will pass through the openings in plate 36 and be retained on a shelf 40 disposed therebeneath. The sorting plates 26–36 are disposed within a substantially encircling annular drum 41 formed of a fixed semicircular lower portion 42 and a removable upper portion 44. The upper portion 44, as best seen in FIG. 3, extends approximately one-forth of the distance around the drum 41 and provides access to the sorting plates. Portion 44 is held in place by a pair of collars 46 (one shown) affixed thereto which slidably engage a pair of pins (not shown) affixed to lower drum portion 42. A plurality of baffle plates 48, one for each sorting plate 26–34, are affixed to the inner surface of drum portion 44 and extend radially inward therefrom between each pair of plates as shown in FIG. 2. The baffles 48 prevent coins dropping through a sorting plate from falling into the coin ejection mechanism of the next lower plate.

The inner surfaces of lower drum portion 42 are configured to minimize the jamming of coins between drum 41 and the sorting plates 26–36. Referring to FIG. 2, the area of drum portion 42 adjacent the periphery of each sorting plate is an annular groove 43 having a diameter only slightly larger than the diameter of sorting plates 26–36 so that a narrow gap is formed therebetween, the gap being less than the thickness of the smallest coin or token to be sorted. Intersecting the edge of each annular groove 43 above the associated sorting plate is an inclined annular surface 45 extending into drum 41 and forming an acute angle with respect to the surface of the sorting plate. A second inclined annular surface 47 intersects the first surface 45 and extends outward therefrom, forming an acute angle with respect to the surface of the sorting plate opposite the angle formed by surface 45. An annular projection having a somewhat triangular cross-section is thus formed, extending radially into drum 41. The effect of inclined surfaces 45 and 47, which are offset by an amount equal to the angle of inclination of the sorter 10, is to cause any coins sliding thereon to fall onto the sorting plates 26–36 under the urging of gravity. The coins cannot be jammed between surface 45 and the sorting plate because of the narrowness of the gap therebetween as explained above. The upper drum portion 44 includes a plurality of spaced apart annular projections 49 having a semicircular cross section and extending from the inner surface thereof into drum 41. Each projection is spaced apart from and is formed above one of the sorting plates 26–36, and serves substantially the same purpose as the projections formed by inclined surfaces 45 and 47 on drum portion 42.

Sorting plates 26–36 are all mounted on a drive shaft 50 rotatably supported by an upper bearing 52 and a lower bearing 54. The bearings 52 and 54 are affixed to support member forming part of a support frame (not shown) to maintain the sorter mechanism 10 at a fixed angle with respect to the horizontal of between about 30–60 degrees, with a preferred angle of about 45 degrees. The lower end of drive shaft 50 carries a gear 56 that is driven by motor 12 through a second gear 58 affixed to the shaft thereof. Sorting plates 26–36 are stabilized and held spaced apart by a plurality of spacers 60 axially disposed therebetween. A disengagement assembly 62 provided for motor 12 is formed of a motor mounting bracket 64 pivotally attached to the sorter 10 support frame. A fixed bracked 66 affixed to the support frame includes a threaded member 68 therethrough which extends through bracket 64. Thus, the rotation of threaded member 68 in one direction causes bracket 64 to pivot about its axis in a counterclockwise direction and thereby engage motor gear 58 with drive shaft gear 56. Rotating member 68 in the opposite direction pivots bracket 64 in a clockwise direction and disengages gear 58 from gear 56, permitting shaft 50 and sorting plates 26–36 to rotate freely about their axis for service, maintenance, or the the removal of a jammed coin.

Coin feed mechanism 14 is formed of a continuous belt assembly 70 disposed at the lower portion of a hopper 72. Coins deposited into hopper 72 are carried by belt 70 in the direction of arrow 74 if FIG. 2 and onto the lower portion of the first sorter plate 26. Disposed within and extending through lower drum portion 42, and associated with each sorting plate 26–36, is a coin level sensor 20 formed of a conducting member 76 mounted in an insulator 78. Conductor 76 is coupled to motor control circuit 18 so that when the level of coins on any sorting plate reaches the height of the associated sensor 20 a conducting plate will be completed from drum portion 42 through the sorting plate, the coins, and conductor 76 to motor control circuit 18, which deenergizes the motor 16 in coin feeder 14. When the level of coins on the affected sorting plate drops below the height of its associated sensor 20, the circuit will be broken and control circuit 18 again energizes motor 16 to permit coins to be fed into sorter 10.

Figure 5:
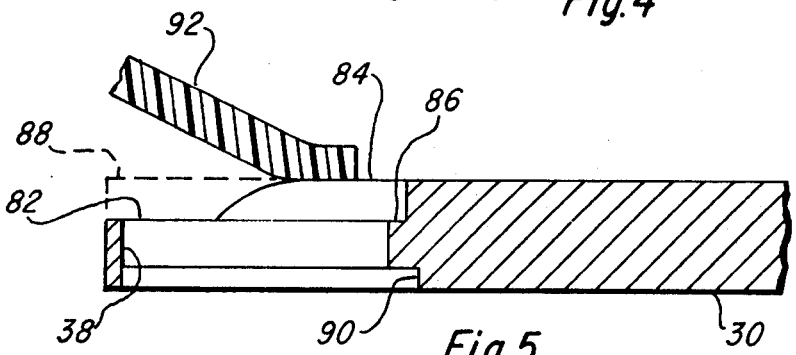
FIG. 5 is a view in vertical section along the line 5—5 through the sorting plate of FIG. 4.

Referring now to FIGS. 4–7, the openings 38 nearest the periphery of each sorting plate 26–36 are uniquely configured to cooperate with a coin ejection mechanism 80 to remove coins therefrom one-by-one without jamming. Only the sorting plate 30 will be described, although the configuration of the peripheral openings on the remaining sorting plates 26, 28, 32, 34 and 36 are essentially the same except for the respective diameters thereof. As best shown in FIG. 5, the peripheral portion of sorting plate 30 is formed into an upper recessed surface 82 and a plurality of arcuate projections 84 extending radially outward and down from the upper surface of plate 30 to the recessed surface 82. Surface 82 is recessed a distance substantially equal to the thickness of a coin to be sorted, i.e., a nickel in the case of sorting plate 30. The projections 84 adjacent each opening 38 form an annular lip 86 to retain a coin 88 thereon, and are configured so that the distance between the outer edge of projection 84 and the edge of sorting plate 30 is slightly less than the radius of opening 38. An opening 90 is the lower surface of plate 30 is countersunk over opening 38 to decrease the thickness of plate 30 beneath annular lip 86. This configuration effectively retains a single coin 88 between each pair of projections 84 while permitting the coin 88 to be readily removed from the sorting plate 30 at the appropriate time.

Figure 7:
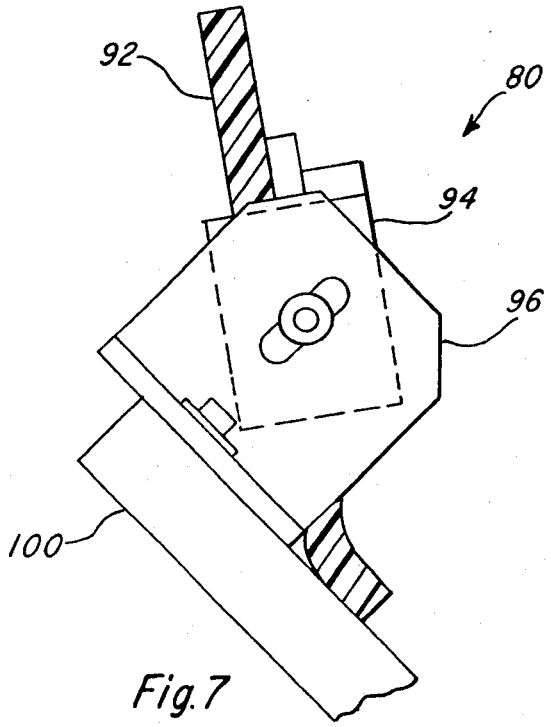
FIG. 7 is a side elevational view of the coin ejection mechanism as viewed along the line 7—7 in FIG. 6.
Figure 6:
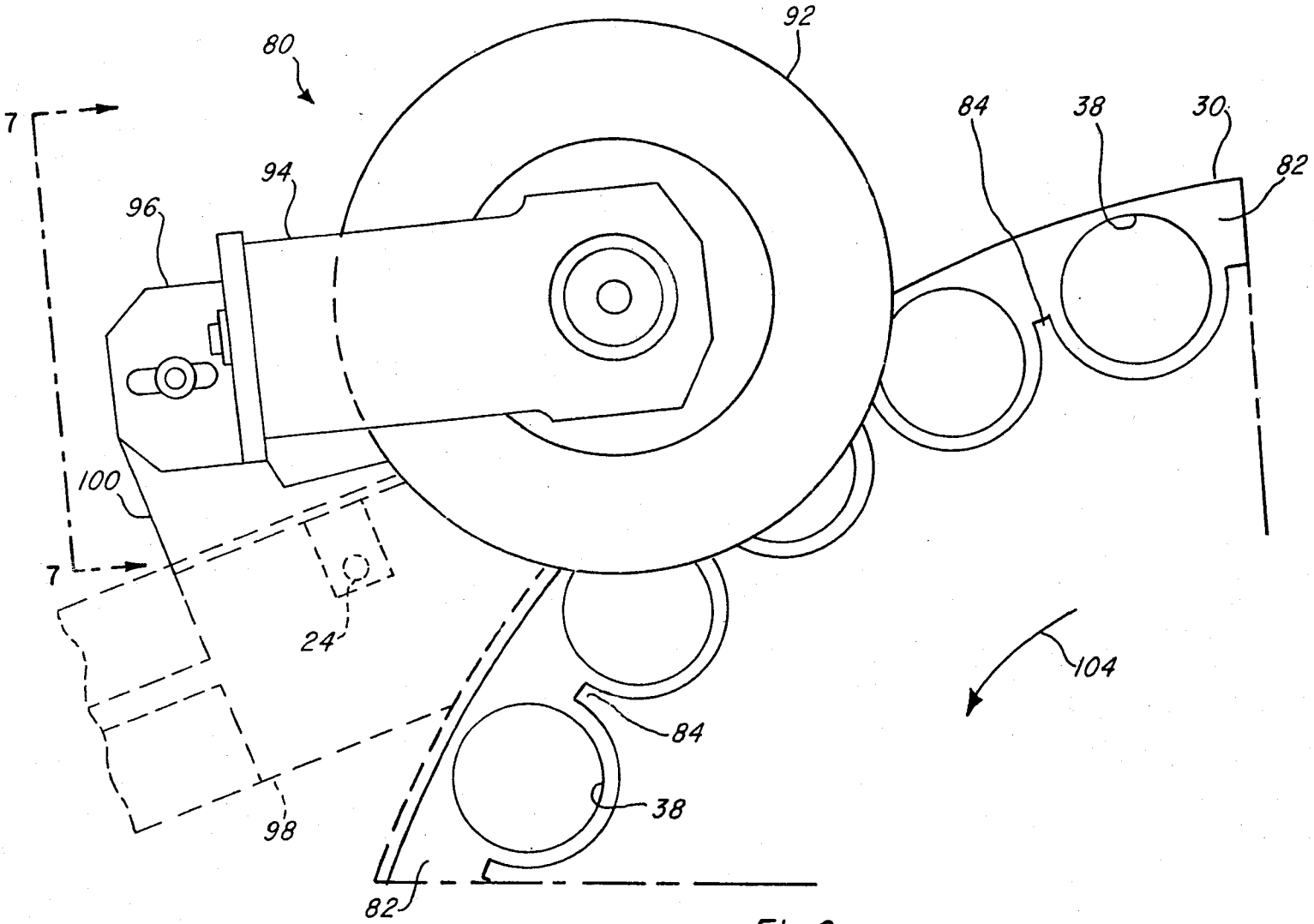
FIG. 6 is an enlarged plan view of the portion of the sorting plate of FIG. 3 including one of a plurality of coin ejection mechanisms.

FIGS. 6 and 7 show the structure of one of the coin ejection mechanisms 80 in greater detail. A flexible wheel 92 is rotatably mounted on a bracked 94 dieposed at the periphery of the sorting plate 30 and is positioned so that a portion of the lower surface of the wheel 92 contacts the upper surface of plate 30 near its periphery. Bracket 94 is adjustably mounted on a second bracket 96 which is also adjustable, thus providing three dimentional adjustment of the flexible wheel 92 with respect to plate 30. Wheel 92, which may conveniently be formed, for example of silicon or rubber, is preferably inclined at an angle with respect to the upper surface of sorting plate 30 to ensure positive contact therebetween. The pressure exerted on plate 30, and coin 88, by wheel 92 is directly proportional to the angle of inclination of wheel 92. Disposed adjacent to and coplanar with surface 82 of sorting wheel 30 is a track assembly having an upper portion 98 (see FIG. 3) affixed to a bracket 100 on which bracket 96 is also adjustably mounted. The track also has a lower portion 99 coplanar with and adjacent to the upper track portion 98, the lower portion 99 being affixed to the sorter 10 support frame. The counting sensor 24 is affixed to the upper edge of track portion 98 near sorting plate 30. Sensor 24 may advantageously comprise an optical, magnetic or other device which will generate a signal when a coin 88 passes under it. In one embodiment sensor 24 is an infrared detector which is illuminated by an infrared source (not shown) disposed in track portion 98 directly therebeneath. In operation, as a coin 88 passes under flexible wheel 92 it slides under the urging of wheel 92 radially outward from the surface of sorting plate 30 and onto the surface of track portion 98. As wheel 92 and plate 30 continue rotating the coin 88 is pushed out from under wheel 92 by the trailing projection 84 and passes under sensor 24, which in one embodiment breaks an infrared light beam and causes a signal to be generated which is detected and processed by CPU 22 to provide the counting function. Coin 88 then slides under the urging of gravity down lower track portion 99 and into a recepticle (not shown).

The mounting brackets 100, one for each sorting plate 26–36, are affixed to a shaft 102 which is mounted at either end to the sorter 10 support frame. In this manner, all of the ejection mechanisms 80 and the upper track portions 98 can be simultaneously removed from sorter 10 as a unit. This provides ready access to the sorting plates 26–36 and other components.

To sort coins using the coin sorter-counter of the present invention, a random mixture of coins is dumped through hopper 72 onto belt 70 whereby they are carried and dumped onto the top sorting plate 26. The largest coins are retained on plate 26 while all coins having a smaller diameter fall through the openings therein as described above. After a short time only nickels (in the described embodiment) will be positioned on the sorting plate 30. Sorting plate 30 will be rotating in the direction of arrow 104 in FIGS. 3 and 6 and about the longitudinal axis of shaft 50, with the plate 30 inclined at an angle of about 45 degrees with respect to the horizontal whereby the lower side of plate 30 as viewed in FIG. 3 will be disposed lower and the upper side of plate 30 as viewed in FIG. 3 will be disposed higher. In the disclosed embodiment if the diameter of plates 26–36 is approximately 12 inches and the speed of rotation is about 30 r.p.m., a sorting rate of approximately 1500 coins per minute can be obtained. The coins will tend to fall to the bottom as viewed in FIG. 3 where they will be picked up one-by-one between the arcuate projections 84 on plate 30. As the coins thus carried by projections 84 are moved upwardly and to the right in FIG. 3, eventually only a single coin 88 will be carried thereby; if a second coin should tend to lie on top of the lower coin, then the upper coin will slide downwardly since the surface of the lower coin is flush with the surface of sorting plate 30. When the coins pass under wheel 92 they are ejected into upper track portion 98 and counted as described more fully hereinabove. The present counter-sorter is particularly advantageous for sorting bent or otherwise damaged coins since the configuration of the peripheral openings 38 in the sorting plates 26–36 permit such coins to be carried thereby and the ejector wheel 92 will remove coins protruding above the surface of the sorting plates. Further, the track portions 98 and 99 permit the counting and discharge of damaged coins because the track size is not critical, the only limitation being that the track must accomodate the largest coin to be sorted.

In another embodiment of the present invention sorter 10 may be reconfigured to sort a mixture of coins wherein there is a substantially larger number of coins of a particular denomination. For example, in the case of vending machines more quarters are normally used therein than nickels and dimes. The reconfiguration is accomplished by including two quarter sorting plates in "series," i.e., one after the other. The first or upper quarter sorting plate must be formed so that the inner rows of openings therein are large enough to pass quarters. The outermost row of openings near the periphery of the sorting plate remaining unchanged, i.e., they are slightly smaller than a quarter. The second quarter sorting plate is identical to plate 28 wherein all of the opening therethrough are the same size. In this manner the upper sorting plate will sort only those quarter which can be retained and carried in the outermost row of openings, while the rest of the quarters fall through to the lower plate where they are retained and sorted. A substantially larger number of quarters can thus be sorted in a given period of time as compared to the embodiment described hereinbefore.

Obviously, many modifications and variations of the present invention are possible in the light of the above teachings. It is therefore to be understood that within the scope of the appended claims the invention may be practiced otherwise than as specifically described herein.

What is claimed is:

1. Coin sorting and counting apparatus comprising:

an annular drum inclined at a fixed angle with respect to the horizontal;

a plurality of spaced apart sorting plates rotatably disposed within said annular drum, each of said plates having a plurality of openings therein configured to retain coins of a particular size while permitting coins of a smaller size to pass therethrough, wherein each of said sorting plates includes an annular row of openings therein disposed adjacent its periphery, said annular row of openings being formed on a surface recessed from the upper surface of said sorting plate a distance substantially equal to the thickness of a coin to be retained thereon, said sorting plate further including a plurality of arcuate projections extending radially outward and downward from said upper surface of said sorting plate to said recessed surface to a distance slightly less than the radius of one of said coins to be sorted, the outermost portion of each of said arcuate projections being narrower than the innermost portion, and wherein each of said openings has a larger countersunk opening therebeneath extending partially upward from the lower surface of said sorting plate;

first drive means operable coupled to said plurality of sorting plates; and a plurality of coin ejector means each cooperatively disposed at the periphery of one of said plurality of sorting plates for removing coins therefrom.

2. Apparatus according to claim 1, further comprising:

automatic coin feeding means disposed at the upper portion of said annular drum so that coins deposited therein are carried onto the lower portion of the first of said plurality of sorting plates, said coin feeding means including a hopper for depositing said coins onto a continuous belt mechanism; and second drive means coupled to said continuous belt mechanism.

3. Apparatus according to claim 2, further comprising:

a plurality of first sensor means each disposed within said annular drum a predetermined height above and at the lower portion of one of said plurality of sorting plates; and control means coupled to each of said plurality of first sensor means and to said second drive means wherein said control means deenergizes said second drive means whenever the level of coins on any one of said plurality of sorting plates equals said predetermined height.

* * * * *